United States Patent [19]

Price

[11] 3,972,376

[45] Aug. 3, 1976

[54] ADAPTER ASSEMBLY FOR IMPACT TOOL UNITS WITH ROTATABLE OR OSCILLATABLE BITS

[76] Inventor: Vernon L. Price, 670 Hillcrest Drive, Reno, Nev. 89502

[22] Filed: Sept. 6, 1974

[21] Appl. No.: 503,770

Related U.S. Application Data

[63] Continuation of Ser. No. 313,469, Dec. 8, 1972, abandoned.

[52] U.S. Cl. ..... 173/139; 173/162; 279/19.1

[51] Int. Cl.[2] ..... B25D 17/08

[58] Field of Search ..... 279/19.1, 19.2, 19.3, 279/19.5, 19.6, 19.7, 20; 173/162, 139, 105, 109, 110, 104, 97; 299/94

[56] References Cited

UNITED STATES PATENTS

| | | | |
|---|---|---|---|
| 1,326,245 | 12/1919 | Worthen | 173/97 |
| 2,461,527 | 2/1949 | Curtis et al. | 173/97 |
| 3,255,832 | 6/1966 | Leavell | 173/162 X |
| 3,356,166 | 12/1967 | Diachenko | 173/139 |
| 3,601,205 | 8/1971 | Kurt | 173/105 |
| 3,666,024 | 5/1972 | Beaumont | 173/105 |
| 3,685,593 | 8/1972 | Amtsberg | 173/105 |

*Primary Examiner*—Ernest R. Purser
*Assistant Examiner*—William F. Pate III
*Attorney, Agent, or Firm*—Limbach, Limbach & Sutton

[57] ABSTRACT

An adapter assembly incorporating the lower chuck end of a rotary impact tool unit, the support means thereof, and the tool bit extending from the lower end thereof. The impact tool unit is of the general type in which the impact motor is not connected directly to the outer support housing but is mounted for upward axial movement in the housing, as a result of recoil forces, to substantially reduce shock and vibration transmitted to the operator who holds the unit by means of a handle carried by the housing. The adapter assembly cooperates with the tool bit to hold it down against the work but permits the tool bit to rotate or oscillate about its axis or to remain in a stationary position angularly relative to the axis.

6 Claims, 5 Drawing Figures

ADAPTER ASSEMBLY FOR IMPACT TOOL UNITS WITH ROTATABLE OR OSCILLATABLE BITS

This is a continuation of application Ser. No. 313,469 filed Dec. 8, 1972 now abandoned.

The adapter assembly of my invention is preferably incorporated in a rotary impact tool unit including an air motor. The motor-mounting arrangement is of the general type disclosed in my U.S. Pat. No. 3,223,181 issued Dec. 14, 1965. In that patent, I have disclosed an outer muffler or support housing having a handle structure for the operator and an inner air motor which is mounted within the housing for upward movement relative thereto so that recoil from the tool bit is transmitted to the motor but not to the outer housing with its handle structure.

In an impact tool unit of this type, within order for it to do much more efficient work, it is desirable to provide means for holding the working bit down against the work instead of permitting it to bounce freely and have the tool bit itself absorb a certain portion of the impact blow. According to this invention, I have provided an adapter assembly which makes it possible to hold the bit down against the work but which will permit the tool bit to rotate or oscillate about its axis during use.

The best mode contemplated in carrying out my invention is illustrated in the accompanying drawings in which.

Figure 1:
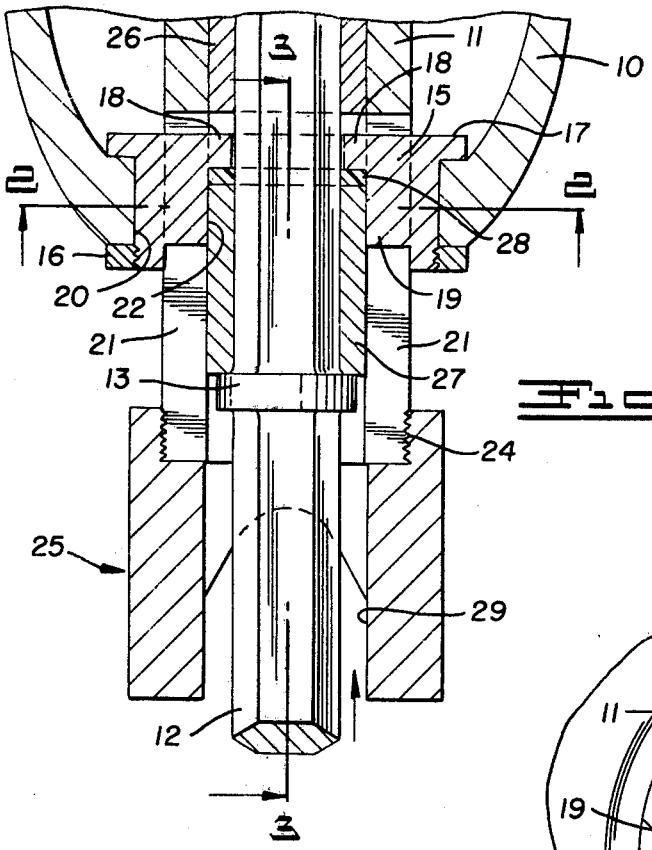
FIG. 1 is an axial sectional view of the adapter assembly on the lower end of an impact tool unit.
Figure 2:
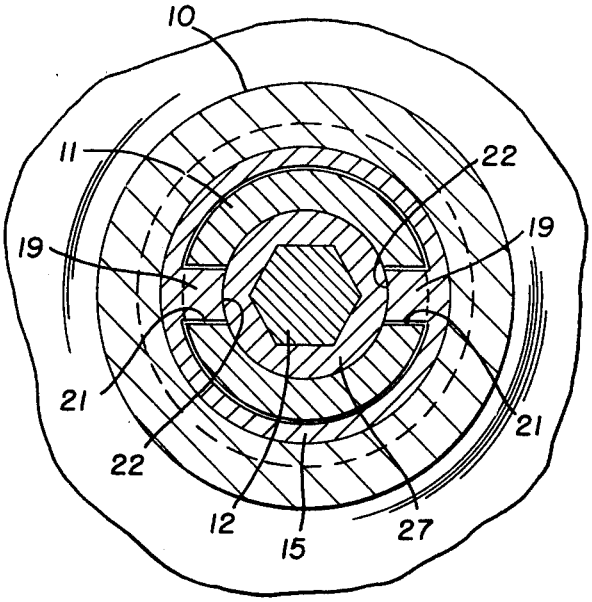
FIG. 2 is a transverse sectional view taken along line 2—2 of FIG. 1.
Figure 4:
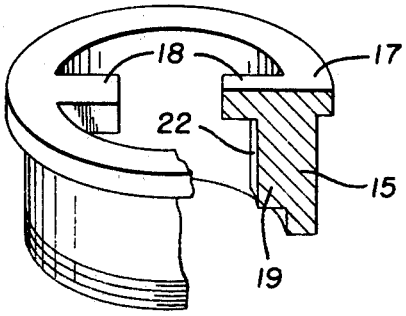
FIG. 4 is a perspective view, partly broken away, of a retainer bushing from the adapter assembly.

With reference to the drawings, the adapter assembly of my invention is shown on the lower end of an impact tool unit which has a motor-supporting arrangement of the general type disclosed in my said U.S. Pat. No. 3,223,181. However, the present invention is applicable to a rotary type impact motor but since the details thereof are well known in the art, the rotary motor is not disclosed herein. The lower end of an outer support housing is indicated at 10 and the lower end of the motor chuck is indicated at 11. The chuck normally holds the usual tool bit 12, which is usually of hexagonal cross-section and is provided with the integral annular shoulder or ring 13. However, as indicated, in said patent, the impact motor and the support or muffler housing are mounted for relative axial movement so that recoil forces will not be transmitted to the outer support housing which will be held by the operator through the medium of a handle carried thereby. Therefore, the adapter assembly shown herein provides for upward axial movement of the chuck 11 relative to the support housing 10 in response to recoil forces as the tool bit 12 engages the work. Thus, these forces will not be transmitted to the operator.

According to this invention, the retainer assembly is composed of an assembly of parts of such cooperating structures as to permit both reciprocation of the tool bit 12 and rotation or oscillation of it about its axis.

Thus, as the impact motor pounds the tool bit into the work, it can rotate or oscillate about its axis.

In order to accomplish this, the housing 10 is provided with a bushing-receiving opening at its lower end for receiving the support bushing 15. This bushing 15 includes a main body insertable from above in the shouldered opening or socket 20 of the support housing 10 and having a lower clamp ring 16 threaded thereon to retain it in the opening with its upper flange 17 resting on an associated shoulder or ledge surrounding the opening. Thus, the flanged support bushing assembly will remain in axial position within the lower end of the support 10, being clamped therein and prevented from moving both axially and angularly. This support bushing 15 is provided with a pair of radially inwardly extending opposed ears 18 having inner ends which are spaced a predetermined distance apart, these ears being formed at the upper ends of radially inwardly extending lugs 19 which extend a substantial portion of the height of the bushing 15. The chuck 11 is of tubular or sleeve-like form and its lower portion is adapted to extend into and cooperate with the bushing assembly 15.

The chuck 11 is mounted for axial or vertical reciprocable sliding movement in the support bushing 15 but is prevented from rotating or oscillating therein. To accomplish this, the chuck 11 is provided with diametrically opposed vertically elongated slots 21 for receiving the opposed lugs 19 of the bushing 15. These slots are closed at their upper ends but their lower ends are at the lower end of the chuck and are open. However, the lower end of the chuck is threaded at 24 to receive the threaded wedge extension 25. The wedge extension will thus close the lower ends of the elongated slots 21. The chuck 11 will be permitted to move vertically relative to the bushing 15 because of the slots 21, but rotation of the chuck in the bushing will be prevented by the radially extending lugs 19 cooperating with the walls of the slots.

Within the chuck 11, I rotatably mount a bushing 26 which has a cylindrical outer surface rotatably engaging the complemental surface on the interior of the chuck. The inner surface of the bushing 26 is hexagonal and complemental to the tool bit surface and slidably receives the tool bit 12. The lower end of this bushing 26 is disposed at a level corresponding to the top closed ends of the chuck slots 21 and it will be noted that the ears 18 on the lugs 19 will extend inwardly below the bushing 26. Thus, downward movement of the chuck 11 relative to the housing 10 will be limited by contact of the lugs 19 with the upper ends of the slots 21 in the chuck. The ears 18 extending below the bushing 26 will keep it in the chuck 11 above the bushing 15. It will be noted that the inner ends of the ears 18 will be adjacent outer angular surfaces of the bit 12.

Below the bushing ears 18 and above the shoulder 13 of the tool bit, I provide the bushing 27 on the tool bit. The bushing is provided with an outer cylindrical surface which rotatably engages the inner tubular surface of the chuck 11 and an inner hexagonal surface which slideably but non-rotatably engages the hexagonal surface of the tool bit. Above the bushing 27 is a thrust collar 28 which has an annular outer surface rotatable on the chuck and a hexagonal inner surface slideably engaging the tool bit. This collar 28 will be located between the upper end of the bushing 27 and the ears 18. It will be noted that the inner edges 22 of the lugs 19 are curved complemental to the adjacent outer surface of the lower bushing 27. Thus, the tool bit will be free to move axially relative to the hexagonal lower and upper bushings 27 and 26 but the bushings will rotate or oscillate with the tool bit whenever it rotates or oscillates about its axis.

The wedge-extension 25 may be of any suitable type but is preferably of the type disclosed in my co-pending application, now issued U.S. Pat. No. 3,865,198 on Feb. 11, 1975, which is provided with a latch arrangement 30 that permits removal and replacement of the tool bit 12. The details of the unit 25 need not be discussed in this application but it will include the retainer body with a bore or opening 29 which is slightly larger in diameter and concentric with the central opening of the chuck 11. It will be sufficiently large to permit axial passage of the tool ring or shoulder 13.

During operation of the impact motor, the adapter assembly will be in the condition shown in FIG. 1. The tool bit 12 will be forced upwardly when its lower end engages the work, causing the tool shoulder 13 to push upwardly on the hex bushing 27 which will push the thrust collar 28 upwardly against the ears 18 of the support bushing 15. The slots 21 in the chuck 11 will extend vertically sufficiently that their upper ends will not engage the bushing 15 during the impact operation. Impact reaction forces will be transmitted upwardly through the tool bit 12 to the chuck 11 and impact motor to move the chuck and motor upwardly without transmitting these vibrations to the outer housing or support 10 and through the handle carried by the housing to the operator. During the impact or pounding action on the tool bit, it is held down against the work by engagement of the lower end of the bushing 27 with the bit shoulder 13, even though recoil forces will move the impact motor and its chuck 11 vertically upwardly within the outer housing 10. The tool bit 12 is held down against the work by means of the ears 18 of the support bushing 15, carried by the support housing 10, through the thrust bearing 28 and hex bushing 27. However, the bit 12 will be free to rotate or oscillate about its axis, since both the lower hex bushing 27 and the upper hex bushing 26 are free to rotate within the chuck 11, as well as move axially vertically therein. Bushing 27 and thrust collar 28 are carried by the support housing 10 and will serve as a thrust bearing in engaging the tool bit shoulder 13 and holding the tool bit down in the work. This holding of the bit 12 down into the work, but permitting its revolution or oscillation about its axis, facilitates penetration of the tool bit into the material. The adapter assembly of this invention permits this action, but still does not interfere with the no vibration arrangement for the outer housing as disclosed in my prior patent, and, in addition, holds the bit down against the work.

Figure 3:
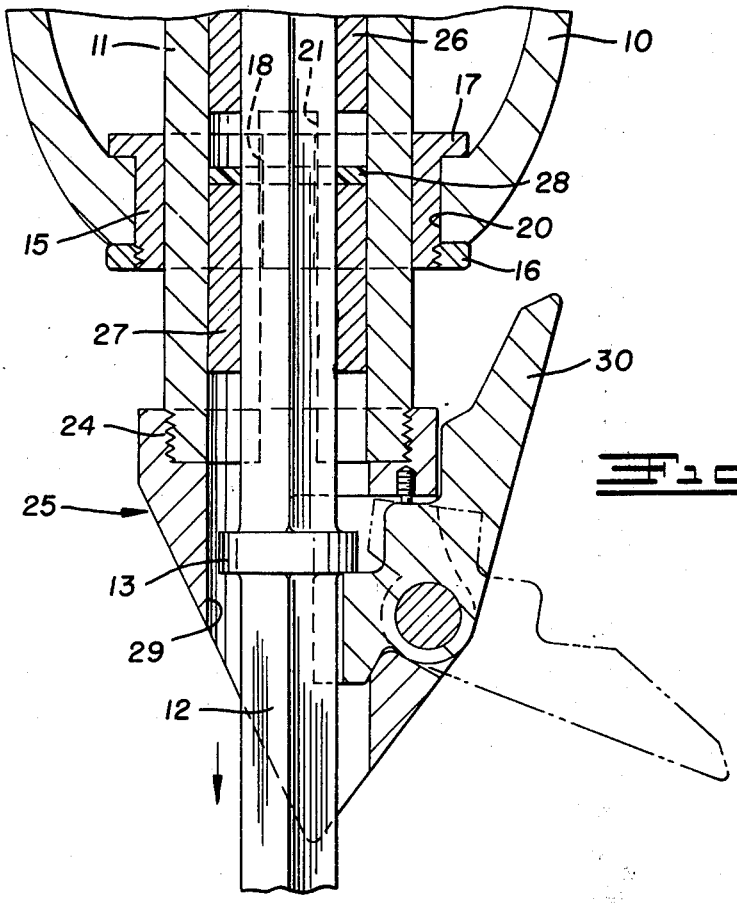
FIG. 3 is a sectional view taken along line 3—3 of FIG. 1.

During operation, the weight of the support housing 10 causes the bushing 27 to ride the tool flange ring 13 most of the time. The weight of the rotary impact motor, of which the chuck 11 is a part, rides the top of the tool bit 12 most of the time. However, when resistance to downward movement of the tool bit 12 is not present, the bit will drop to the position indicated in FIG. 3 where the tool bit shoulder 13 will engage the latch 30 that will prevent it from dropping farther. At this time, the hex bushing 27 and collar 28 will also drop downwardly. Preferably, the tool unit will be equipped with an automatic shut-off (not shown) to stop the motor when this occurs.

Figure 5:
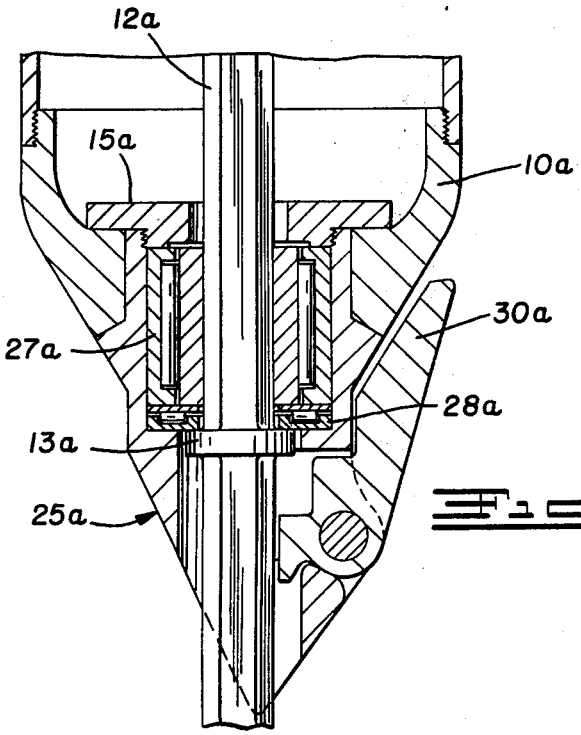
FIG. 5 is an axial sectional view of an adapter assembly using a rotary bearing for the tool bit.

In FIG. 5, I have shown another adapter arrangement which includes a rotary anti-friction bearing for permitting rotation of the tool bit while it is held down against the work. This arrangement is used instead of the rotary hex bushing 27 of the above described assembly and also incorporates the no vibration arrangement of my patent. In this arrangement, a rotary impact motor with a short chuck (not shown) is used and the chuck will move axially upwardly relative to the housing as in the patent. The rotary anti-friction bearing is mounted in the support housing 10*a*. An anti-friction bearing, such as a roller bearing 27*a*, is mounted within the support 10*a* in a fixed axial position and includes an inner hexagonal bushing surrounding the tool bit 12*a*. The adapter housing 25*a* is provided with an upwardly opening socket portion for receiving the bearing 27*a* and this socket portion receives on its upper end a threaded clamping collar 15*a* which retains the member 25*a* in the member 10*a*. Below the bearing 27*a* is an anti-friction thrust bearing 28*a* which may also be of the roller type. This bearing 28*a* will be engaged by the tool shoulder ring 13*a* during the impact tool operation. The latch 30*a* will ordinarily prevent the tool bit from dropping out of the unit.

It will be apparent that with this arrangement, during the impact work operation, the thrust bearing 28*a* will engage the shoulder 13*a* to hold the tool bit 12*a* down against the work. The tool bit will be free to rotate or oscillate about its axis because of the rotary bearings 27*a* and 28*a*. The impact reaction forces will not be transmitted to the outer housing 10*a* and the operator gripping the handle carried thereby.

It will be apparent from the above description that my invention provides for an adapter assembly for use with the no vibration structure of my prior patent and this assembly holds the tool down tight against the work during the impact operation, and permits it to rotate or oscillate about its axis or remain in a stationary angular position.

Having thus described my invention, what is claimed is:

1. In combination a two-body adaptation of an impact tool device having a first body comprising a main support, a tool bit having a shaft and a workhead, means for mounting said tool bit for rotational and axial movement, said tool bit having a shoulder disposed at a location along its shaft before its workhead, and a second body comprising separate means cooperating with the tool bit for imparting both axial impact and rotational forces thereto including an adapter assembly mounted on said main support body and comprising:

a bearing support on said main support in a fixed axial position and carrying a bearing through which said tool bit axially extends with its shoulder below the bearing, said bearing including means for preventing rotation of said bit relative thereto while allowing the bit to slide axially therein;

said bearing including thrust bearing means for engaging said tool bit shoulder so as to hold the tool bit down against the work under impact but permit turning of the bit about its axis and an elongated, slotted chuck forming a part of said second body which extends through said fixed main bearing support of said first body for axial movement relative thereto to prevent transmission of impact forces to the support.

2. The combination of claim 1 in which the main support of said first body is a housing having an open lower end, said adapter assembly being mounted in said open lower end;

said bearing support being axially fixed in said lower end of the housing, and said bearing comprising an inner bushing disposed within said bearing support and being rotatable therein, said bearing support having means for engaging said inner bushing to limit upward axial movement of said bushing into the housing when said bushing through said thrust bearing means engages said tool bit shoulder.

3. The combination of claim 2 in which the tool bit has its shoulder intermediate its length and the shank end thereof is of angular cross section; and said inner bushing has a bit-receiving socket extending therethrough of complemental cross section so that the bit is free to slide axially therein but is prevented from rotating relatively therein.

4. The combination of claim 2 in which:

said bearing is an antifriction bearing mounted in said bearing support and includes said inner bushing, and said bearing support comprises means for supporting the bearing in a fixed axial position in the lower end of the main support housing of said first body with said thrust bearing means at the lower end of said inner bushing.

5. The combination of claim 1 in which said elongated chuck of said second body extends downwardly through the lower end of the main support housing of said first body and has vertically extending slots formed therein; and said bearing support comprises an outer bushing mounted in fixed axial position in said lower end of the housing and receives the lower end of the chuck for relative axial movement, said inner bushing is rotatable in the outer bushing, and lugs on said outer bushing extending radially inwardly thereof into the slots of said chuck for preventing rotation of the chuck in the bushing but permitting relative axial movement therein;

said lugs carrying shoulders to provide the means for limiting upward axial movement of said inner bushing so that its lower end will be positioned below said outer bushing and engage said shoulder, and a thrust collar at the inner end of said inner bushing and engaged by said shoulders.

6. The combination of claim 5 in which said tool bit is carried by another bushing disposed in the chuck axially inwardly of said outer bushing shoulders, said last-named bushing having a socket complemental to the angular cross-section of said bit to receive the bit for axial movement but to prevent rotation therein and being rotatably mounted in said chuck.

* * * * *

UNITED STATES PATENT AND TRADEMARK OFFICE

CERTIFICATE OF CORRECTION

PATENT NO. : 3,972,376

DATED : August 3, 1976

INVENTOR(S) : Vernon L. Price

It is certified that error appears in the above-identified patent and that said Letters Patent are hereby corrected as shown below:

In the ABSTRACT, line 7, delete "in" and insert --within--.

Column 1, line 18, delete "within" and insert --in--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*